United States Patent [19]

Sjöstedt

[11] 4,202,642

[45] May 13, 1980

[54] LOOSE-LEAF BINDER UTILIZING STIFF COVERS

[76] Inventor: Lars L. Sjöstedt, Ellagårdsvägen 96, S-183 39 Täby, Sweden

[21] Appl. No.: 919,920

[22] Filed: Jun. 28, 1978

[51] Int. Cl.[2] ..... B42F 13/02

[52] U.S. Cl. ..... 402/13; 402/17; 402/64; 402/68

[58] Field of Search ..... 402/8, 13, 15, 17, 21, 402/22, 59, 64, 68, 500, 502, 501

[56] References Cited

U.S. PATENT DOCUMENTS

| | | | |
|---|---|---|---|
| 434,625 | 8/1890 | Coppuck | 402/13 |
| 1,469,388 | 10/1923 | McBee | 402/17 |
| 2,013,097 | 9/1935 | Hanna | 402/17 |
| 3,224,450 | 12/1965 | Whittemore et al. | 402/17 |

FOREIGN PATENT DOCUMENTS

| | | | |
|---|---|---|---|
| 326687 | 8/1970 | Sweden | 402/17 |
| 1080727 | 8/1967 | United Kingdom | 402/17 |
| 1225120 | 3/1971 | United Kingdom | 402/17 |
| 1313579 | 4/1973 | United Kingdom | 402/17 |
| 1401302 | 7/1975 | United Kingdom | 402/17 |

*Primary Examiner*—Paul A. Bell

*Attorney, Agent, or Firm*—Oblon, Fisher, Spivak, McClelland & Maier

[57] ABSTRACT

The disclosed apparatus is capable of uniting a cover with a sheaf of pages having through holes at purely optional locations. A flexible stem binds the pages and has its ends engaged by separate runners positioned adjacent the sheaf. The cover is connected to the runners at a position opposite the sheath so that the stem ends need not pass through the cover. The elastic flexibility of the stem permits the cover to open without bending.

7 Claims, 7 Drawing Figures

LOOSE-LEAF BINDER UTILIZING STIFF COVERS

BACKGROUND OF THE INVENTION

The invention relates to a device for removably binding a sheaf of pages with edge holes, e.g. data lists, to a stiff cover. A stem passes through one of the through-holes in the sheaf, this stem being for example a string or strip of plastics or metal, having an end protruding out from the sheaf and bent over a latching element or runner, which is retained by guiding means on the inside of the cover.

Such a device is known, e.g. through the Swedish lay-open print No. 326 687, and has a guide means in the form of a stiff C-section rail, attached to an edge strip which is hingedly connected to the cover and constitutes a foldable portion thereof. The edge strip of the cover has through slots for each fastening stem running through the sheaf, this slot registering with a slot complementary in size and location in the web of the rail. The stem is threaded through the complementary slots in the cover and rail and through a hole in a first latching element to be bent over said element. The stem is then locked by means of a second latching element, serving as a keeper, which presses the free end of the stem against the rail web. The device is rather complicated and only allows limited adaptability to different hole location in the sheaf, since the slots can only extend over short individual portions of the height of the cover, if this region is to have any strength.

The object of the invention is to provide a device which is substantially simpler than the one already known, and which permits the use of an entirely optional hole pitch at the fastening edge of the sheaf.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views, and wherein.

DETAILED DESCRIPTION OF THE PREFERRED EMBODIMENTS

Figure 1:
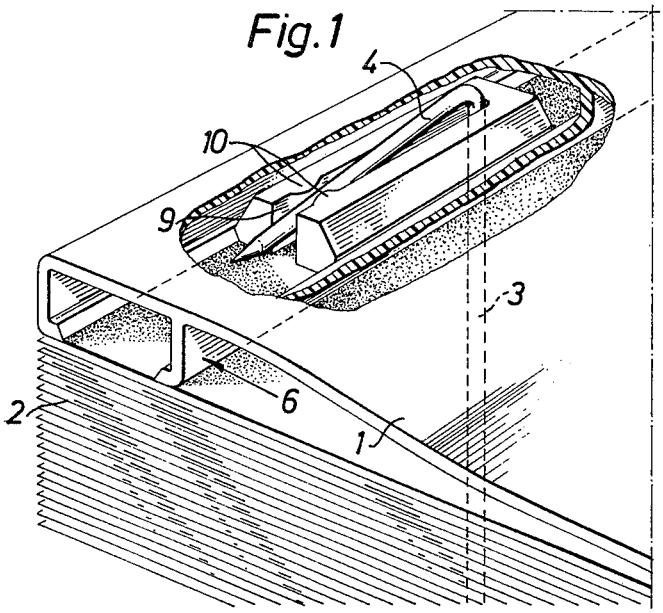
FIG. 1 is a schematic perspective view of a corner portion of a cover and a sheaf of papers, to which the cover is attached by means of stems keeping together the sheaf, only an end portion of one stem being shown. A portion of the cover and its guide means are cut away to facilitate illustration of how the stem is fastened by a latching means or runner.

A cover 1 is removably attached to a sheaf of papers 2 having through holes, e.g. data lists, by means of a stem 3, e.g. a plastics rod or string. The stem 3 is entered in a through hole in the sheaf and can have one end attached in an optional way on the underside of the sheaf, which is not shown in FIGS. 1 and 2, although suitably connecting the sheaf to a cover here as well. Two or more of the holes in the sheaf are suitably provided with stems. A separate stem can be used for each such hole, or one and the same stem can be threaded so that each end comes through its own hole. Each free stem end 4, arranged one way or another to project from the sheaf, can be fastened at the front or back of the sheaf by means of a device according to the invention. FIGS. 3–6 give examples of arrangements resulting in one or more such ends 4.

It is apparent from FIG. 1 that the stem end 4 is taken through a hole in a runner 5 and bent over the runner.

Figure 2:
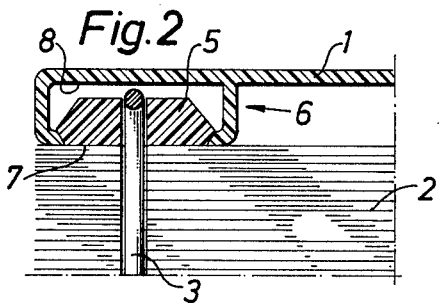
FIG. 2 shows a partial section through the same corner portion as shown in FIG. 1. The section is taken perpendicular to the longitudinal axis of the guide means, along the longitudinal axis of a hole in the sheaf, through which one of the stems extends.
Figure 3:
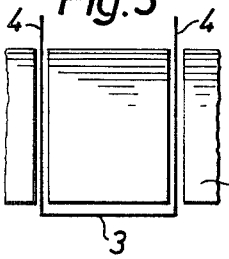
FIGS. 3–6 schematically show some examples of how one or two stems can be fitted, at the same time showing one to four ends, any or all of which can be used in the device according to the invention for fastening on one, or both sides, of the sheaf.
Figure 4:
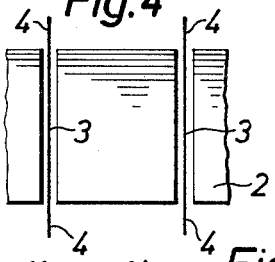

After the connection just described between the runner 5 and the stem end 4 according to the embodiment in FIGS. 1 and 2, the runner is inserted in a guide means 6 having a C-section, made integral with and on the inside of the cover 1, along the whole of the spine edge of the cover. The runner can thus be displaced in the guide means to an optional position along the whole height of the cover.

In contrast to the previously known device, the guide means 6 extends along the spine edge of the cover, which is generally just as stiff over the whole of its width, the edge portion thus not being hinged, and not intended to be folded. The runner 5 is juxtaposed with the sheaf 2, and can receive the stem 3 without the latter first passing any hole in the cover 1, which is therefore not perforated in any way.

The trough facing the sheaf, and formed by the C-section of the guide means according to FIGS. 1 and 2, has a restricted frontal aperture 7 (FIG. 2), formed by beads on the flanges 6 outstanding from the web 8, and the runner 5 is adapted to be glidably retained in the trough by the beads on the flanges. The frontal aperture 7 allows free passage for the stem 3.

The runner 5 and trough in the guide means 6 are so dimensioned that a portion of the end 4 of the stem 3, bent over the runner, is accommodated between the bottom 8 of the trough and the runner (FIG. 2), the bottom 8 thus serving as a locking means for the end 4 bent over the runner.

The cover and sheaf can be united by the runner being inserted in either of the open ends of the trough 7. It will be appreciated that more than one runner with associated stem can be used. The edge chamfers of the runner shown in FIGS. 1 and 2 can be combined to advantage with such elastic deformation of the C-section beads that the runner can be pressed into the trough through the frontal aperture 7, whereby the edge chamfers serve as pressing means.

The runner 5 shown in FIG. 1 has a split 9 parallel to the longitudinal axis of the guide means 6 and adjacent to the through hole for the stem end 4, this slit being adapted for receiving a portion of the end 4. The slot is provided with a pair of mutually opposing projections 10 to retain the end 4 by snap action when the end is pressed down into the slit. A reliable connection between the sheaf 2, stem 3 and runner 5 can thereby already be provided before the runner 5 is inserted into the guide means 6, and has the stem portion adjacent the bend in the through hole pressed against the trough bottom 8.

The stems are to advantage made sufficiently flexible and with friction suitably adjusted between them and their runners so that a certain amount of movement is allowed when opening the binder for consulting the pages thereof, whereby the page sought can be completely exposed right out to the edge adjacent to the fastening. Even here, it is expedient for the covers to be stiff, and not provided with crease lines or the like. The cover portions thereby function as a kind of lever which urges the stem to glide in the runner for allowing convenient exposure of the page sought. When this page is no longer wanted, light opposing pressures on either cover will cause the stems to return to their previous position, so that the runners keep the loose leaves and covers tightly together.

Figure 7:
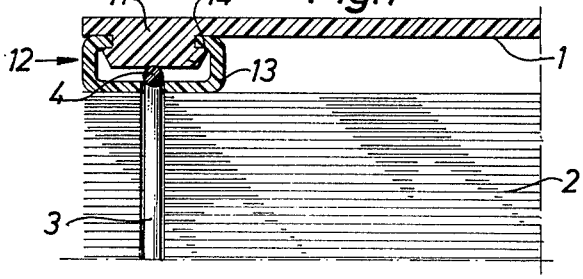
FIG. 7 shows a partial section corresponding to FIG. 2, for a somewhat modified embodiment of the invention.

In the embodiment according to FIG. 7, the guide means 11 has a T-head cross section, and the runner 12 has a C-shaped cross section, the beads of the C-section and the grooves of the T being complementary and with suitable clearance, for the runner to be retained in the rail while being longitudinally displacable therein. The end 4 of the stem 3 is also passed through a hole in the runner in this embodiment, and bent so that it will be caught between the runner and rail when the runner is introduced into the rail 11, thus locking the bend over the runner. The runner can be coupled to the rail by insertion from the end thereof or by the side walls 13 of the runner being elastically deflectable and receptive to the pressing chamfers 14 on the T flanges of the guide rail 12, so that the guide rail can be pressed down into the trough of the runner, the flange beads of the runner being inserted in the slots of the rail by snap action. The rail 6 or 11 of the cover 1 accordingly serves as coupling means for the runner 5 or 12, and allows optional location of these runners with relation to the respective hole pitch of the sheaf, each stem end 4 coacting with a runner, and the runners having a length small enough for at least two runners to be accommodated by the rail 6, 11 and located in positions allowing adjustment to very different hole pitches.

In the embodiment according to FIG. 7, the guide means is also made in one piece with the cover, and similar to the embodiment according to FIGS. 1 and 2, it can very easily be incorporated into the production of plastics covers. It is also expedient for the runners to be made from plastics.

Figure 5:
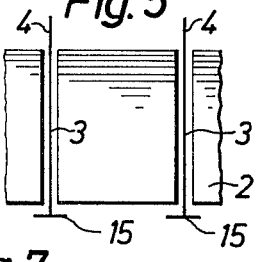
Figure 6:
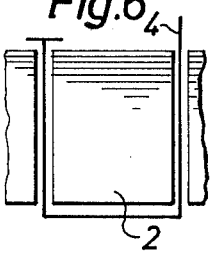

Particularly when they are made from plastics, the stems 3 can easily be made with a head 15 at one end, as indicated in FIG. 5, each head being formed for coaction with a guide means 6 or 11 on a cover, while the opposite ends 4 of the stems are joined to the opposite cover according to FIGS. 1, 2 or 7.

What is claimed as new and desired to be secured by Letters Patent of the United States is:

1. An apparatus for removably uniting a cover with a sheaf of pages having through holes at optional locations, said apparatus comprising:

at least one stem, each said stem passing through at least one said through hole thereby exposing one stem end for each said through hole passed through;

a separate first connecting means receiving each said stem end in a bent condition, each said first connecting means being positioned immediately adjacent said sheaf at its respective through hole whereby said stem passes only through said sheaf and said first connecting means;

a cover for said sheath;

a rail-like second connecting means positioned along the spline edge of said cover, said second connecting means being engagable with each of said first connecting means for connecting said cover to said sheaf at a position opposite said first connecting means; and whereby said first connecting means may be positioned at optional hole spacings and said stems may be engaged without passing through said cover.

2. A device as claimed in claim 1, wherein said second connecting means (6) has a trough, facing inwardly towards the sheaf (2), with a constricted frontal aperture (7), the first connecting means (5) being configured for glidable retention in the trough.

3. A device as claimed in claim 1, wherein said second connecting means (11) consists of a rail with a T-section, the first connecting means being configured for glidable retention while fitting into the T-grooves of the rail.

4. A device as claimed in claim 1 wherein said first connecting mans (5, 12) and the second connecting means (6, 11) accommodate a portion of the end (4) of the stem (3) between them, said head being bent over the first connecting means, while the second connecting means (6, 11) is adapted for retaining the end (4) to maintain the bend.

5. A device as claimed in claim 2, wherein said first connecting means (5) is sufficiently elastic that it can be pressed into the trough in the second connecting means (6) through the frontal aperture (7) of the trough, as a result of its own elastic deflection and such deflection of the trough flanges and beads.

6. A device as claimed in claim 3, wherein said first connecting means (13) is sufficiently elastic that it can be pressed on to the second connecting means (11), formed as a rail, as a result of its own elastic deformation and such deformation in the rail.

7. A device as claimed in claim 1, wherein said stems are elastic, and the friction between said stems and the runners is so adjusted that a certain amount of movement results from one gliding in relation to the other when opening the binder for use.

* * * * *